US009072123B2

(12) United States Patent
Hammerschmidt

(10) Patent No.: US 9,072,123 B2
(45) Date of Patent: Jun. 30, 2015

(54) HEATED SET, IN PARTICULAR FOR SEATS OF BENCHES

(76) Inventor: Jan Hammerschmidt, Mužla (SK)

( * ) Notice: Subject to any disclaimer, the term of this patent is extended or adjusted under 35 U.S.C. 154(b) by 571 days.

(21) Appl. No.: 13/382,570

(22) PCT Filed: Jul. 6, 2010

(86) PCT No.: PCT/SK2010/050013

§ 371 (c)(1),
(2), (4) Date: Jan. 6, 2012

(87) PCT Pub. No.: WO2011/005229

PCT Pub. Date: Jan. 13, 2011

(65) Prior Publication Data

US 2012/0111846 A1 May 10, 2012

(30) Foreign Application Priority Data

Jul. 8, 2009 (SK) ..... 50036-2009

(51) Int. Cl.

| | |
|---|---|
| ***H05B 1/00*** | (2006.01) |
| ***A47C 7/74*** | (2006.01) |
| *H05B 3/34* | (2006.01) |

(52) U.S. Cl.
CPC *H05B 3/34* (2013.01); *A47C 7/748* (2013.01); *H05B 2203/011* (2013.01); *H05B 2203/017* (2013.01); *H05B 2203/026* (2013.01); *H05B 2203/029* (2013.01)

(58) Field of Classification Search
USPC ..... 219/217, 212, 211, 528–9, 541, 544–5, 219/549
See application file for complete search history.

(56) References Cited

U.S. PATENT DOCUMENTS 7,019,261 B2 * 3/2006 Worrell et al. ..... 219/204

FOREIGN PATENT DOCUMENTS

WO 9809478 * 3/1998

* cited by examiner

*Primary Examiner* — Shawntina Fuqua
(74) *Attorney, Agent, or Firm* — Black McCuskey Souers & Arbaugh, LPA

(57) ABSTRACT

Areal shapeable heating element (2) covered by electro-insulation foil (3), with metal heat-conductive layer (4) placed above whereof, is placed on the seating part of the bench (1). The set is covered from the top and side of the bench (1) by carpet decorative layer (5).

11 Claims, 1 Drawing Sheet

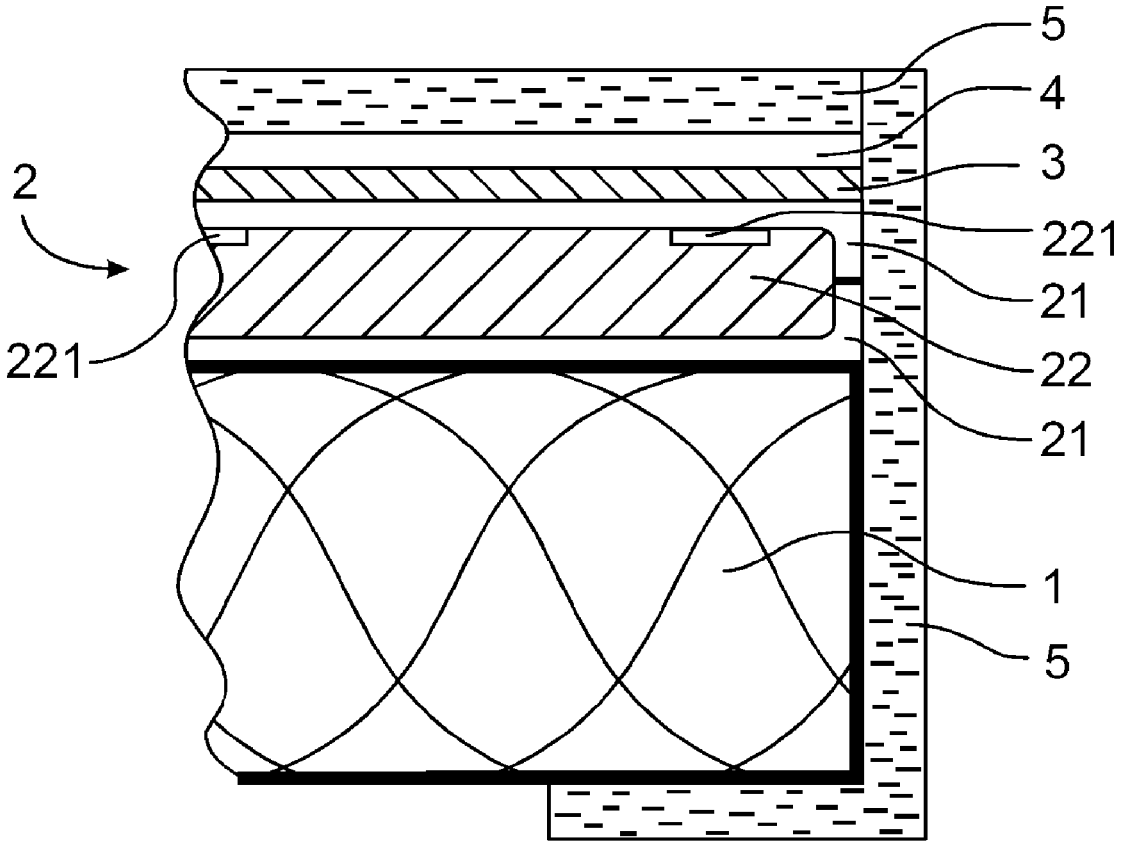
5
4
3
2
221
21
221
22
21
1
5

HEATED SET, IN PARTICULAR FOR SEATS OF BENCHES

TECHNICAL FIELD

The present invention relates to heated set, in particular for seats and rests of benches.

BACKGROUND ART

In case of simple seats of bench type, made in particular of wood, metal, stoneware or plastics, their seating and resting parts are usually uncomfortable as for shape and cold as for feeling. Various pads, rests and other accessories are made for improving sitting, while higher quality can be achieved, besides suitable selection of seating material, also by suitable heating of contact surface.

Known constructions include in particular design according to the patent file DE No. 3,334,744, where seating set is composed of sheet-metal layer moulded between two plastic layers. Similarly, according to the patent file DE No. 1,635,508, a heating wire is placed between two plastic layers. The design described in the patent file GB No. 1,319,168 is designated for heating of walls, while a heating wire is impregnated into a textile fabric, which is covered by plastic foil.

Disadvantages of these designs are in particular uneven distribution of temperature and complicated fabrication of a set.

Design of flat heating element, where a heating wire is woven into textile fabric, is known from the patent file DE No. 2,607,949. The disadvantage of this solution is that it is dangerous to touch due to electric current, and also heating is not even.

DISCLOSURE OF INVENTION

Mentioned disadvantages are eliminated to the substantial degree by heated set, in particular for seats of benches, comprising of heating element and supplementary layers, according to the present inventions, the substance whereof consists in that the heating element is formed by graphite textile fabric, which is placed in the envelope of upper and bottom layer of plastic insulation with metal heat-conductive layer separated from the heating element by the layer of electro-insulation foil placed over it, while the set is covered by textile fabric decorative layer.

The graphite textile fabric is equipped on both sides by electricity-conductive strips with side contacts for supplying electrical current.

Earth wire is connected to heat-conductive layer.

Decorative layer is placed on the surface or on the surface and at least one edge of the set.

The heating element and supplementary layers are made of shapeable materials.

The advantage of the set is better areal thermal distribution of heating, simple assembly and good formability to shapes of the body, what ensures higher comfort of sitting.

BRIEF DESCRIPTION OF DRAWINGS

The design is further elucidated on enclosed drawing, where the FIG. 1 illustrates cross-section of the set.

MODE(S) FOR CARRYING OUT THE INVENTION

The heated set (FIG. 1) for seating part of the wooden bench 1 comprises of the heating element 2 with the width of 1.2 mm, with copper sheet with the width of 0.15 mm, forming heat-conductive layer 4, placed above thereof. The copper sheet is electrically earthed (not indicated on the drawing) and insulated from the side of heating element 2 by polyester electro-insulation foil 3 of Mylar type with the width of 0.25 mm. The copper sheet is covered from above by carpet, which forms the decorative layer 5 and also front head of the bench 1 is covered by this layer.

The heating element 2 is made of graphite textile fabric 22, equipped on both sides by electricity-conductive strips 221 terminated by contact terminals (not indicated on the drawing). The envelope of this heating element 2 comprises of upper and bottom layer of plastic insulation 21 mechanically joined on both side ends of the graphite textile fabric 22.

The set is assembled in such manner that first of all, lengthwise strips are cut from the heating element strip 2, fitted to the whole area of seating part of the bench 1. Upon cutting, by means of special pliers, contact terminals for supply of electric current are pressed on ends of electricity-conductive strips 221, electrical conductors are attached whereon (not indicated on the drawing). Contact terminals and ends of electricity-conductive strips 221, which were uncovered by cutting, are insulated. Heating element prepared in such manner is placed onto the bench 1 and covered by the electro-insulation foil 3, copper sheet of heat-conductive layer 4 is placed whereon, which serves for even diffusion of heat throughout whole area of the bench 1, while earthing conductor thereof is connected with earth, whereby protection against contact with dangerous voltage is ensured. In last phase of assembly, carpet material is placed on the surface of the seat of the bench 1 and its edge, as the decorative layer 5, onto earthed heat-conductive material.

INDUSTRIAL APPLICABILITY

Heated set according to the present design can be used in particular for seating parts of benches, or also for its resting parts and practically for all types of seats, including also automobile one, or for heating of various other spaces designated for it, not excepting floors and walls of interior or exteriors of buildings.

With floor heating, significant part of energy can be saved compared to classic heating being used for the time being, e.g. by radiators, and the air temperature can be decreased by 2-3° C. With lower temperature and higher relative humidity, the temperature feeling is better as in case of mentioned radiator heating. Floor heating powered by electric energy can be easily regulated, what is advantage of this heated set.

Heating of benches in institutions with no heating appears to be especially advantageous. Such heating can be used e.g. in churches, theatres, metro stations, street stalls etc.

The invention claimed is:

1. A heated set for use in combination with seats of benches comprising:

a heating element formed by a graphite textile fabric and electrically conductive strips in contact with opposing sides of the graphite textile fabric;

the graphite textile fabric and electrically conductive strips placed between an upper layer and a lower layer of plastic insulation which together form an envelope of the heating element;

an electrically insulating layer located against the envelope of the heating element;

a thermally conductive layer located over the electrically insulating layer;

a cover layer which covers the thermally conductive layer, the electrically insulating layer and the envelope of the heating element.

2. The heated set according to claim 1, wherein the graphite textile fabric is equipped on both sides by with an electricity-conductive strips with side contacts for supplying electrical current.

3. The heated set according to claim 1 wherein the cover layer is positioned over the thermally conductive layer and over at least one edge of the heated set.

4. The heated set according to claim 1 wherein the heating element, the electrically insulating layer, the thermally conductive layer and the cover layer are made of shapeable materials.

5. The heated set of claim 1 wherein the electrically insulating layer is comprised of polyester electro-insulation foil.

6. The heated set of claim 1 wherein the thermally conductive layer is comprised substantially of copper.

7. The heated set of claim 1 further comprising an electrical connection from the thermally conductive layer to an electrical ground.

8. The heated set of claim 7 wherein the thermally conductive layer is positioned over and substantially covers the electrically insulating layer and over the envelope of the heating element, and the cover layer substantially covers the thermally conductive layer, whereby the cover layer is protected from electrical current by the electrically insulating layer and by the thermally conductive layer and the electrical connection of the thermally conductive layer to an electrical ground.

9. The heated set of claim 1 wherein the cover layer is positioned proximate to a top surface of the thermally conductive layer and extends over a side edge of the thermally conductive layer, a side edge of the electrically insulating layer, and a side edge of the envelope of the heating element.

10. The heated set of claim 1 in combination with a bench with the envelope of the heating element positioned proximate to a support surface of the bench, the electrically insulating layer located on a side of the envelope of the heating element opposite the support surface of the bench, and the thermally conductive layer located over the electrically insulating layer, and the cover layer extending over a top surface of the thermally conductive layer and over a side edge of the thermally conductive layer, over a side edge of the electrically insulating layer, over a side edge of the envelope of the heating element, and over a side edge of the bench.

11. The heated set of claim 1 wherein the cover layer is comprised of carpet material.

* * * * *